US007376239B2

(12) United States Patent
Kirjavainen

(10) Patent No.: US 7,376,239 B2
(45) Date of Patent: May 20, 2008

(54) ELECTROMECHANICAL TRANSDUCER AND METHOD FOR TRANSFORMING ENERGIES

(75) Inventor: Kari Kirjavainen, Tampere (FI)

(73) Assignee: Panphonics Oy, Tampere (FI)

( * ) Notice: Subject to any disclaimer, the term of this patent is extended or adjusted under 35 U.S.C. 154(b) by 353 days.

(21) Appl. No.: 10/682,043

(22) Filed: Oct. 9, 2003

(65) Prior Publication Data

US 2004/0113526 A1 Jun. 17, 2004

Related U.S. Application Data

(63) Continuation of application No. PCT/FI02/00301, filed on Apr. 10, 2002.

(30) Foreign Application Priority Data

Apr. 11, 2001 (FI) ..... 20010766

(51) Int. Cl.
*H04R 9/06* (2006.01)

(52) U.S. Cl. ..... 381/414; 381/191

(58) Field of Classification Search ..... 381/191
See application file for complete search history.

(56) References Cited

U.S. PATENT DOCUMENTS 3,136,867 A * 6/1964 Brettell ..... 381/116
3,894,199 A * 7/1975 Tamura et al. ..... 381/116
4,419,545 A 12/1983 Kuindersma
4,533,794 A 8/1985 Beveridge
4,654,546 A * 3/1987 Kirjavainen ..... 307/400
5,682,075 A * 10/1997 Bolleman et al. ..... 310/309
6,934,402 B2 * 8/2005 Croft et al. ..... 381/412

FOREIGN PATENT DOCUMENTS

| | | |
|---|---|---|
| DE | 3542458 | 6/1986 |
| WO | WO97/31506 | 8/1997 |
| WO | WO99/56498 | 11/1999 |

* cited by examiner

*Primary Examiner*—Sinh Tran
*Assistant Examiner*—Walter F Briney, III
(74) *Attorney, Agent, or Firm*—Marshall, Gerstein Borun LLP

(57) ABSTRACT

An electromechanical transducer comprising at least one transducer element which has a multilayer structure comprising at least two layers such that the transducer element is capable of changing its thickness. The transducer element allows air to flow inside the transducer element in the direction of thickness thereof and inside and out of the transducer element through at least one surface of the transducer element in the direction of thickness of the transducer element. The transducer element can be used e.g. for transforming energy from mechanical energy into electric energy and/or vice versa.

7 Claims, 6 Drawing Sheets

ELECTROMECHANICAL TRANSDUCER AND METHOD FOR TRANSFORMING ENERGIES

Figure 1:
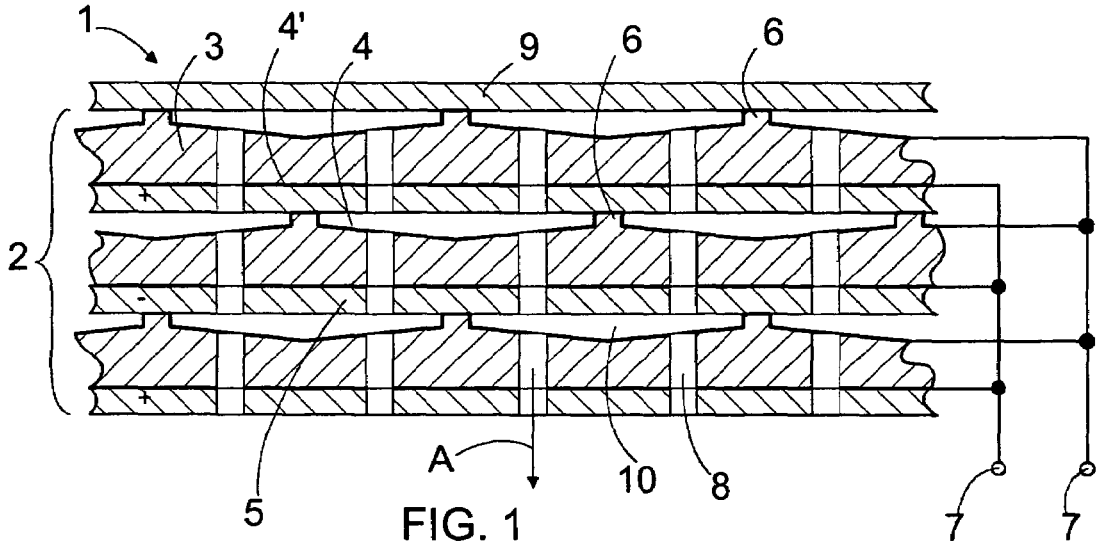

This application is a Continuation of International Application PCT/FI02/00301 filed on Oct. 4, 2002, which designated the U.S. and was published under PCT Article 21(2) in English.

The invention relates to an electromechanical transducer comprising at least one transducer element which has a multilayer structure comprising at least two layers such that the transducer element is capable of changing its thickness.

The invention further relates to a method for transforming energies from mechanical energy into electric energy and/or vice versa, the method comprising producing at least two transducer elements which have a multilayer structure comprising at least two layers such that the transducer element is capable of changing its thickness.

Electrostatic transducers are known wherein an electrostatically moving film is provided e.g. between porous stator plates. In such a solution, the motional amplitude and force of the films remain low or the necessary control voltages are very high. An example of such an electrostatic transducer is disclosed in WO 97/31506.

WO 99/56498 discloses an electromechanical transducer which comprises layers arranged on top of each other, each layer comprising at least one porous layer and a plastic film arranged at a distance from the porous layer. The porous layer and the plastic film come into contact with each other substantially only at supporting points. The supporting points enable the entire structure to change its thickness. A change in thickness is produced by means of an electric field; as the thickness is reduced, the layers are pressed towards each other, simultaneously pressing the air between the plastic films. However, it takes a great force to press air; therefore, the amplitude of such a transducer remains relatively low.

An object of the present invention is to provide a novel electromechanical transducer and a method for transforming energies.

The electromechanical transducer of the invention is characterized in that the transducer element allows air to flow inside the transducer element in the direction of thickness thereof and inside and out of the transducer element through at least one surface of the transducer element in the direction of thickness of the transducer element.

Furthermore, the method of the invention is characterized in that the transducer element allows air to flow inside the transducer element in the direction of thickness thereof and inside and out of the transducer element through at least one surface of the transducer element in the direction of thickness of the transducer element and that the transducer elements are controlled separately.

The idea underlying the invention is that the electromechanical transducer comprises at least one transducer element which has a multilayer structure comprising at least two layers to enable the transducer element to change its thickness. A further idea is that the transducer element allows air to flow inside the transducer element in the direction of thickness thereof and inside and out of the transducer element through at least one surface of the transducer element in the direction of thickness of the transducer element. The idea underlying an embodiment is that the electromechanical transducer is provided with at least one air impermeable layer. The idea underlying a second embodiment is that the electromechanical transducer comprises at least two transducer elements that can be controlled separately. The idea underlying a third embodiment is that the electromechanical transducer comprises at least two transducer elements with an air impermeable layer arranged therebetween. The idea underlying a fourth embodiment is that the electromechanical transducer comprises at least two transducer elements and the outer surfaces of the transducer elements are provided with an air impermeable layer such that air is allowed to flow from a first transducer element to and back from a second transducer element through the surface against the second transducer element.

An advantage of the invention is that since air is allowed to flow freely through the surface of an element in the direction of thickness of the element, no force to resist movement occurs when the thickness of the transducer element varies, thus enabling the amplitude of the transducer element to be increased considerably. The transducer element is thus provided with an extremely good efficiency since the layers do not have to work against pressure when the thickness of the transducer element varies, i.e. even a low control voltage enables a relatively large deformation and/or movement to be achieved or, similarly, a deformation and/or movement of the transducer element produces quite a strong signal. When the electromechanical transducer is provided with at least one air impermeable layer, the transducer is capable of producing sound pressure. When the electromechanical transducer is provided with at least two transducer elements that can be controlled separately, a structure can be achieved, for example, wherein the acceleration of the centre of mass of the transducer generates energy when the transducer is moved. On the other hand, the centre of mass can also be moved. Furthermore, when the different transducer elements of the transducer can be controlled separately, different directional/sound patterns can be achieved. Providing the outer surfaces of the electromechanical transducer with air impermeable layers such that air is allowed to flow substantially only from one transducer element of the electromechanical transducer to another, and feeding opposite-phase signals into different transducer elements enable an electromechanical transducer to be achieved wherein while one transducer element becomes thinner, another transducer element becomes thicker, and vice versa. However, the thickness of the entire electromechanical transducer thus remains constant and the centre of mass of the entire structure moves. The unperforated surfaces of the transducer move in opposite direction to that of the centre of mass, i.e. although the thickness of the transducer remains unchanged, the surfaces of the element yet move. Furthermore, the surfaces of the transducer move in phase, producing sound or vibration.

Figure 2:
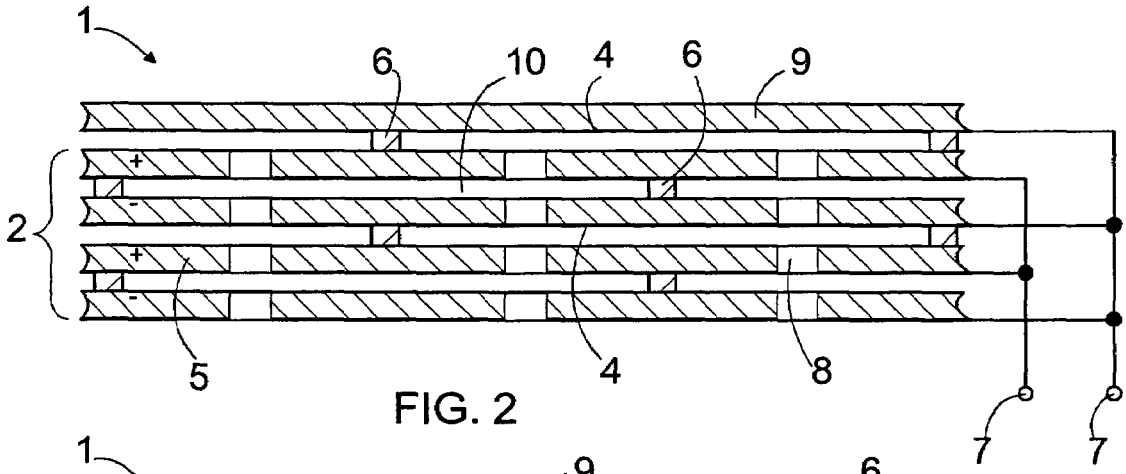
Figure 3:
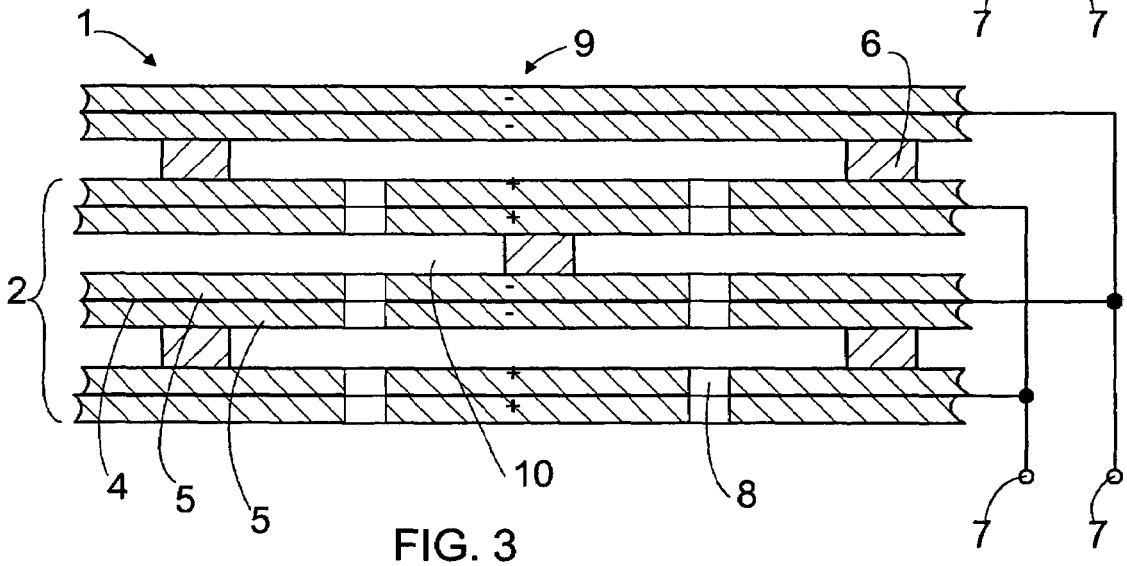
Figure 4:
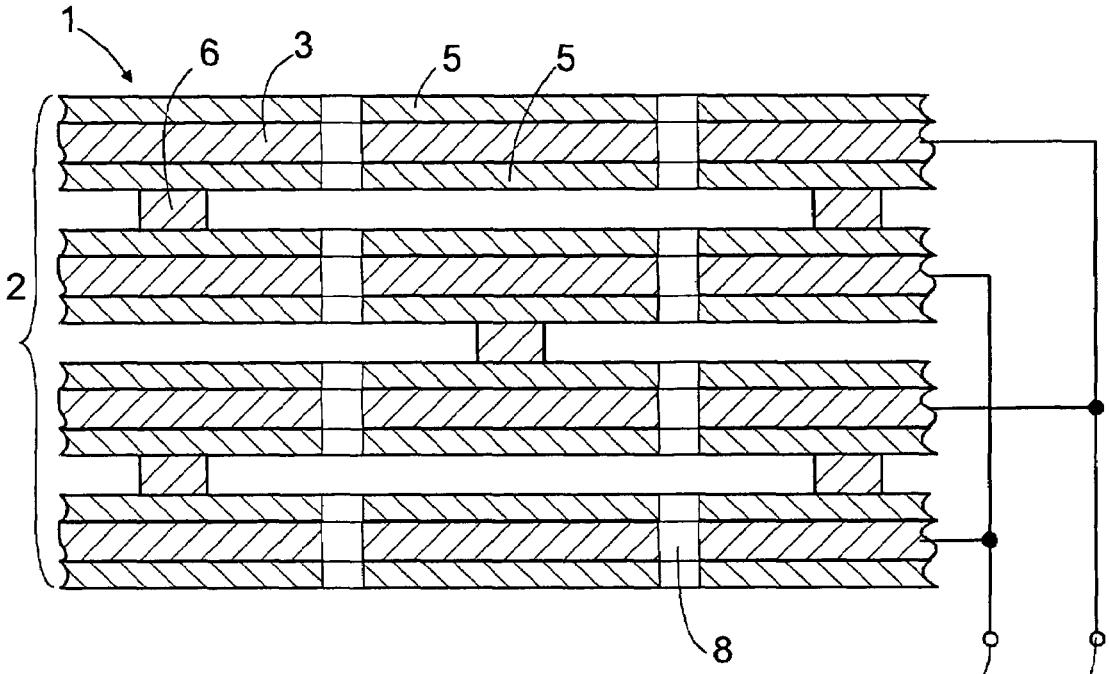
Figure 5:
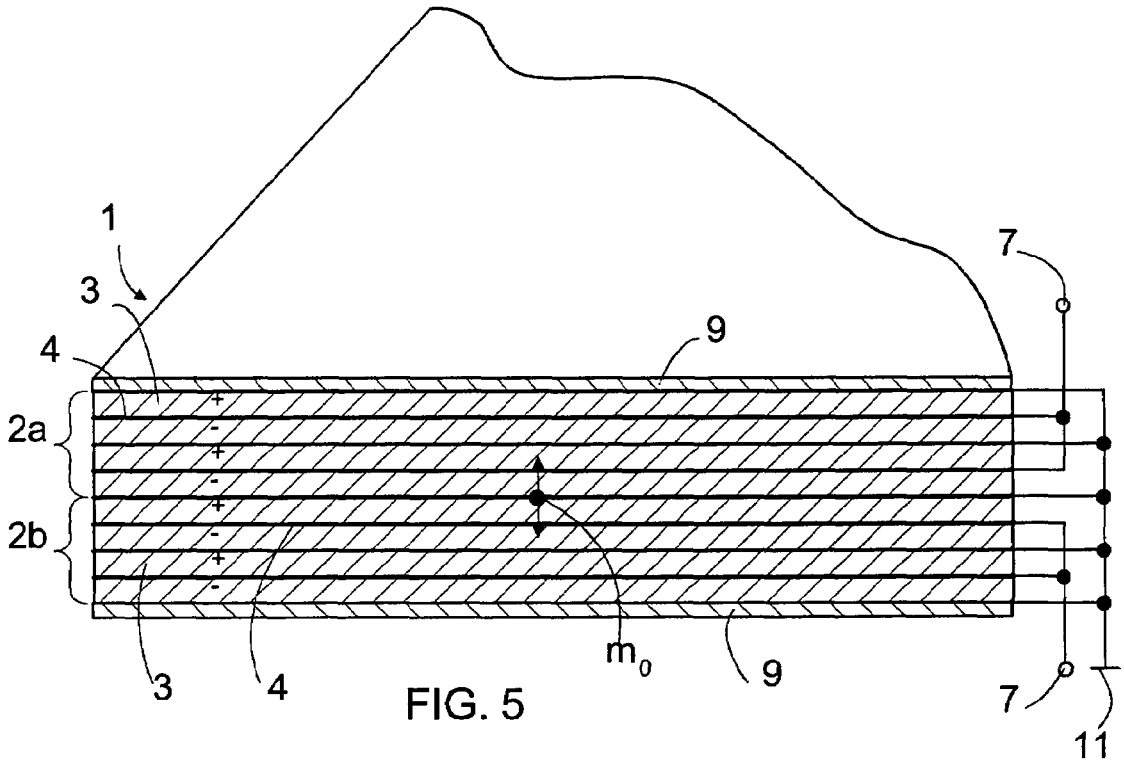
Figure 6:
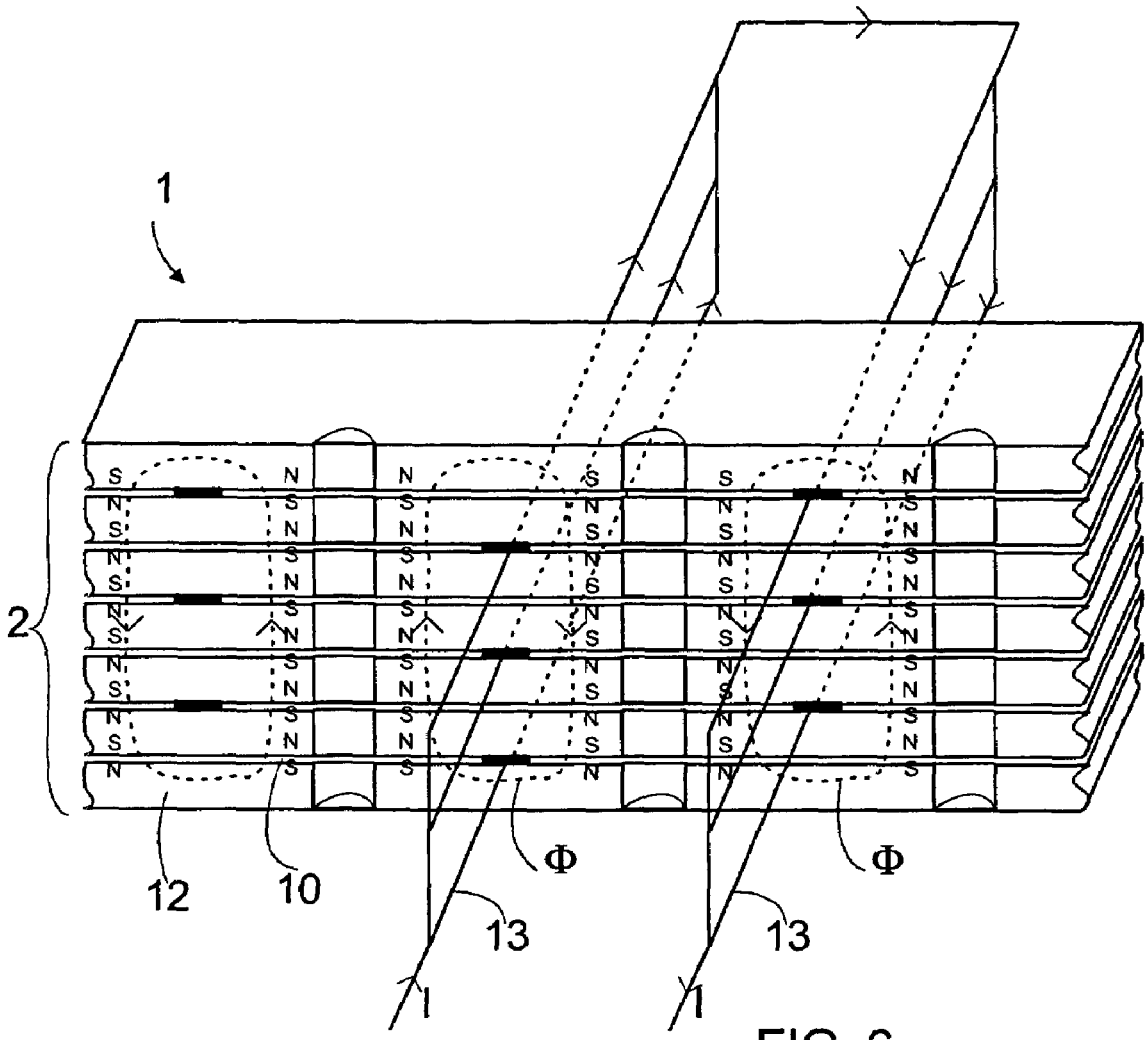
Figure 7A:
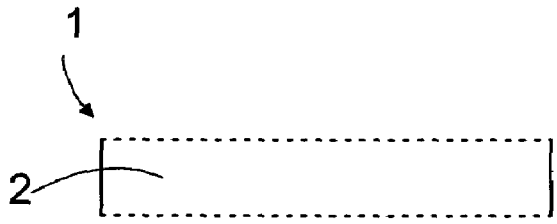
Figure 7B:
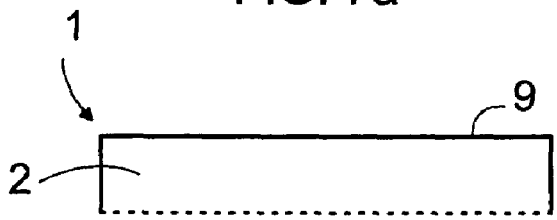
Figure 8A:
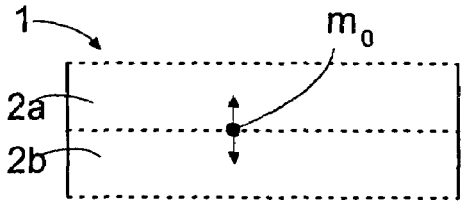
Figure 8B:
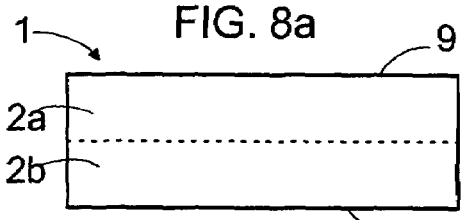
Figure 8C:
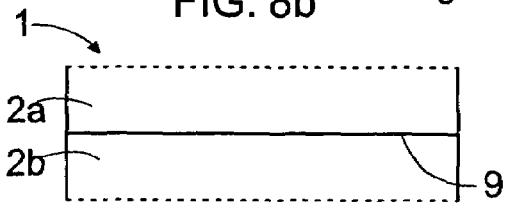
Figure 8D:
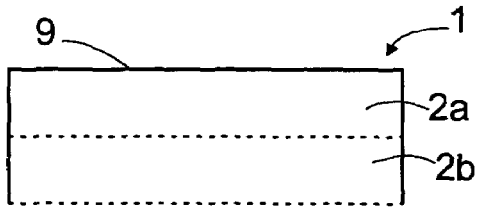
Figure 8E:
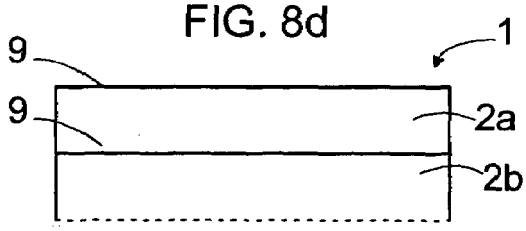
Figure 9A:
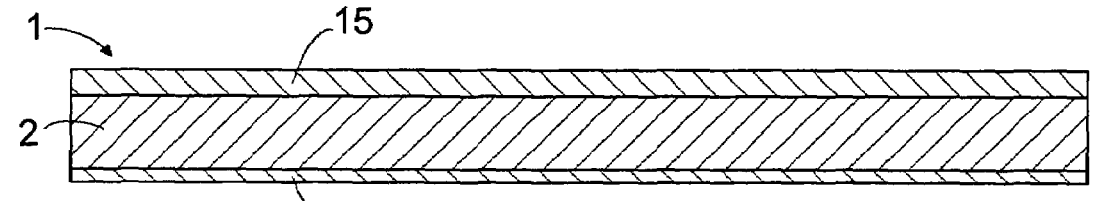
Figure 9B:
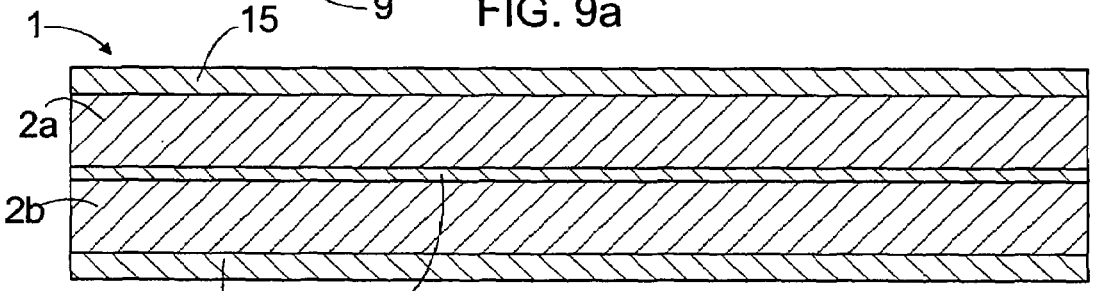
Figure 9C:
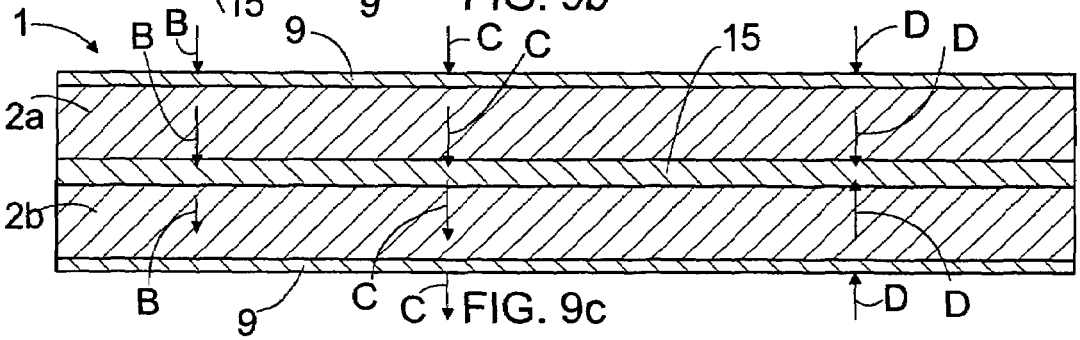
Figure 10:
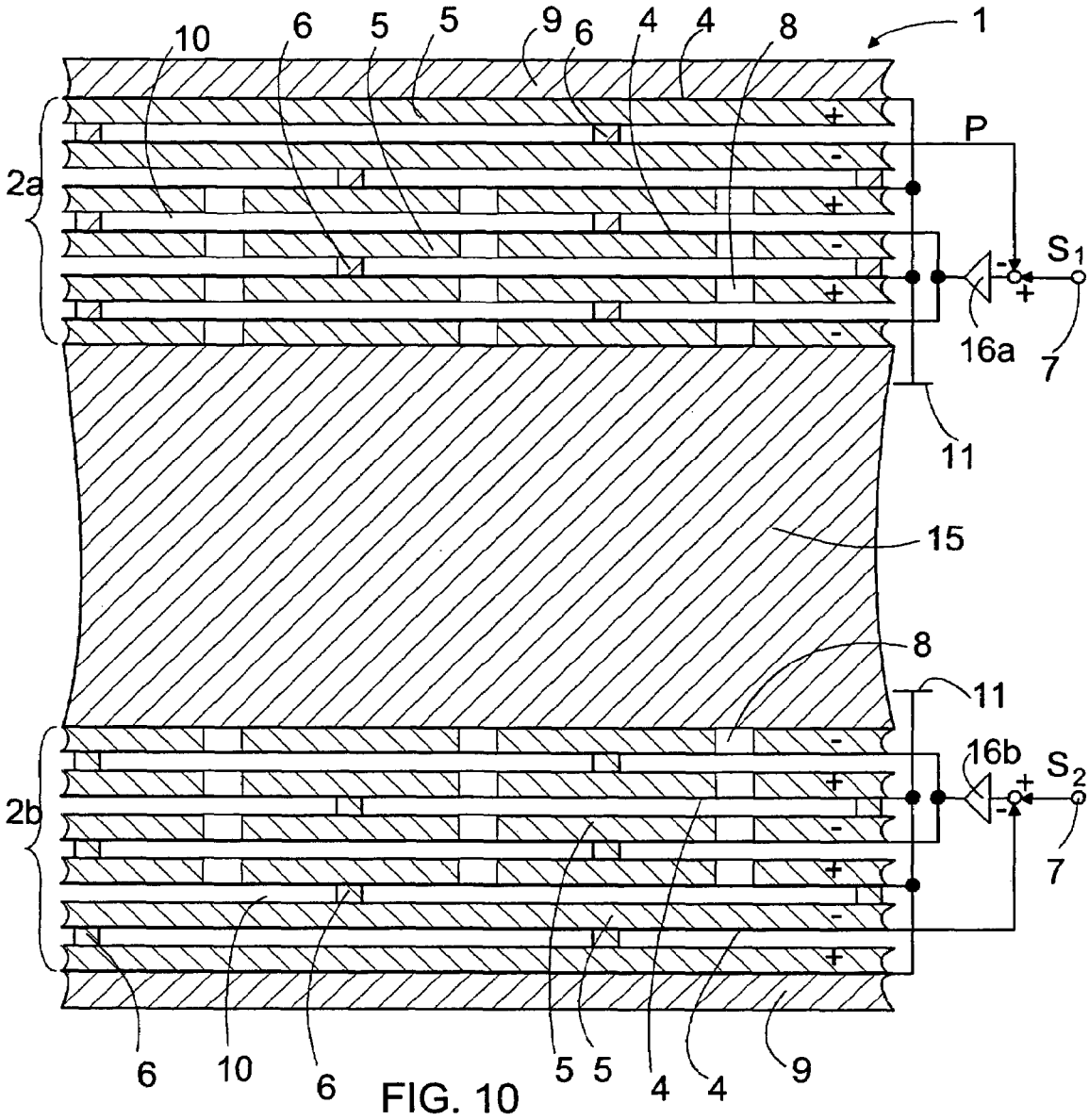

The invention will be described in closer detail in the accompanying drawings, in which FIG. 1 is a cross-sectional side view schematically showing an electromechanical transducer, FIG. 2 is a cross-sectional side view schematically showing a second electromechanical transducer, FIG. 3 is a cross-sectional side view schematically showing a third electromechanical transducer, FIG. 4 is a cross-sectional side view schematically showing a fourth electromechanical transducer, FIG. 5 is a cross-sectional view schematically showing a fifth electromechanical transducer as seen obliquely from above, FIG. 6 is a cross-sectional view schematically showing a sixth electromechanical transducer as seen obliquely from above, FIGS. 7*a* and 7*b* schematically show electromechanical transducers in accordance with the invention, FIGS. 8*a*, 8*b*, 8*c*, 8*d* and 8*e* schematically show further electromechanical transducers in accordance with the invention, FIGS. 9*a*, 9*b* and 9*c* are side views schematically showing embodiments of an electromechanical transducer, FIG. 10 is a detailed view showing an electromechanical transducer in accordance with FIG. 9*c*, FIGS. 11*a*, 11*b* and 11*c* schematically show uses of the electromechanical transducer in accordance with FIG. 9*c*, and FIGS. 12, 13 and 14 are cross-sectional side views schematically showing electromechanical transducers.

FIG. 1 shows an electromechanical transducer 1. The electromechanical transducer 1 comprises a transducer element 2 consisting of a multilayer structure. The transducer element 2 comprises porous layers 3 made of an elastic material. Elasticity herein refers to the bending of a material. The upper and lower surfaces of the porous layers 3 are provided with a metal layer 4. A plastic film 5 serving as a non-conductive layer is attached to the underside of the porous layer 3. The plastic film 5 may be made e.g. of polypropylene, polymethyl pentene or cyclic olefin copolymer. Furthermore, the plastic film 5 may be charged as an electret film.

The porous layer 3 is provided with projections that serve as supporting points 6 such that an air gap 10 is provided between the plastic film 5 and the porous layer 3 thereunder. The porous layer 3 may be e.g. approximately 200 micrometers thick and the air gap 10 may be e.g. approximately 50 micrometers in magnitude. The plastic film 5, in turn, may be e.g. approximately 30 micrometers thick.

Electrodes 7 are coupled to the metal layers 4 and 4' between which the air gap 10 resides. A control voltage is supplied between the electrodes 7. The control voltage makes the successive metal layers 4 and 4' to move with respect to each other, i.e. either towards each other or away from each other. The supporting points 6 are located at different points in successive air gaps 10 such that when the metal layers 4 and 4' are pressed towards each other, the porous layers 3 made of an elastic material bend, enabling the transducer element 2 to change its thickness substantially in its entirety. The different layers of the transducer element 2 are further provided with openings or holes 8 that allow air to flow in and out of the transducer element 2 in the direction of thickness thereof without the air being substantially compressed.

The upper surface of the electromechanical transducer is provided with an air impermeable layer 9, which can be made of a similar material to that of the plastic film 5; naturally, the air impermeable layer 9 is not provided with any openings or holes. When the transducer element 2 is then compressed, air is allowed to flow through the openings or holes 8 downwards, as indicated by arrow A. When the effect of the control voltage is removed, the porous layers 3 made of an elastic material resume the shape disclosed in FIG. 1, in which case air flows upwards as seen in FIG. 1. Similarly, if the thickness of the transducer element 2 is increased by the effect of the control voltage between the electrodes 7, air flows upwards as seen in FIG. 1 through the openings or holes 8. When the transducer element 2 undergoes deformation, the air impermeable layer 9 also undergoes deformation, producing sound pressure or vibration.

FIG. 2 shows an electromechanical transducer 1 wherein the transducer element 2 comprises plastic films 5 arranged on top of each other and charged as an electret film such that they are provided either with a positive or a negative charge, as illustrated in FIG. 2. The underside of the plastic films 5 is provided with a metal layer 4 with electrodes 7 coupled thereto. Supporting points 6 are arranged between the plastic films 5 to provide air gaps 10 between the plastic films 5. The plastic films 5 and the metal layers 4 are provided with openings or holes 8. The supporting points 6 are located at different points in successive layers. Also in this case, the upper surface of the electromechanical transducer is provided with an air impermeable layer 9. The plastic film 5 may be e.g. 30 micrometers thick and the air gap 10 may be e.g. 20 micrometers in magnitude. The operation of the electromechanical transducer of FIG. 2 corresponds to that of the electromechanical transducer of FIG. 1.

FIG. 3 shows an electromechanical transducer 1 wherein the layers of a transducer element 2 have been constructed by combining two charged plastic films 5 with each other and by providing a metal layer 4 therebetween, an electrode 7 being coupled to the metal layer. Supporting points 6 may be e.g. adhesive points or adhesive strips.

FIG. 4 shows an electromechanical transducer 1, the multilayer structure of a transducer element thereof comprising a porous layer 3 whose both sides are provided with a plastic film 5. The porous layer 3 may be made e.g. of a carbon fibre or a corresponding conductive porous material. The porous layer can thus also be made e.g. of a metal fibre material, such as a nonwoven metal fibre. Since the porous layer 3 is made of a conductive material, an electrode 7 can be coupled to the porous layer 3. The electromechanical transducer in accordance with FIG. 4 comprises no air impermeable layer, so air is allowed to pass through the upper and lower surfaces of the transducer element 2.

FIG. 5 shows an electromechanical transducer comprising two transducer elements 2*a* and 2*b*. Both of the transducer elements 2*a* and 2*b* have a multilayer structure comprising a porous layer 3 made of a material compressible in its direction of thickness, at least one side of the porous layer being provided with an air permeable metal layer 4 e.g. by vacuum evaporation. The porous material 3 may comprise a permanent electric charge. Electrodes 7 are coupled to every second metal layer 4 and every second metal layer 4 is connected to an earthing electrode 11. The upper and lower surfaces of the electromechanical transducer 1 are provided with an air impermeable layer 9. Since the porous layer 3 is made e.g. of a fibre fabric or another air permeable porous material, and the metal layer 4 is also air permeable, air is allowed to flow from one layer to another in the transducer element and air is further allowed to flow from the upper transducer element 2*a* to the lower transducer element 2*b* and vice versa.

A signal is fed into the upper transducer element 2*a*, and a corresponding but opposite-phase signal is fed into the lower transducer element 2*b*, and when the upper transducer element 2*a* becomes thinner, the lower transducer element 2*b* becomes thicker, allowing air to flow from the upper transducer element 2*a* to the lower transducer element 2*b*. The total thickness of the electromechanical transducer, however, thus remains substantially the same. However, the centre of mass $m_0$ of the electromechanical transducer 1 moves at the same time. The air impermeable layers 9 constituting the upper and lower surfaces of the electromechanical transducer 1 move in opposite direction to that of the centre of mass $m_0$, i.e. although the thickness of the electromechanical transducer 1 does not change, the element actually moves. The upper and lower surfaces move in phase, thus producing sound and vibration. The effect of a control signal on the different transducer elements 2*a* and 2*b* can be provided with opposite phase also by changing the charges of the porous layers 3 of one transducer element 2*a* or 2*b* to be of opposite sign to those shown in FIG. 5. In such a case, the transducer 1 operates as disclosed above when a similar and also cophasal signal is fed into both of the transducer elements 2*a* and 2*b*. Being simple, such a solution is also advantageous when the transducer 1 is used for producing electric energy from the moving or deformation of the transducer 1.

FIG. 6 shows an electromechanical transducer 1 whose transducer element 2 comprises magnetized layers 12 arranged on top of each other and being provided with air gaps 10 therebetween. A magnetized layer 12 is made e.g. of a mixture of a plastic and a powdery magnetic material such that about half the material consists of plastic and half the material consists of the powdery magnetic material. This enables a permanently magnetizable layer to be achieved. The magnetized layer 12 may be e.g. 200 micrometers thick and the air gap 10 may be e.g. 50 micrometers in magnitude. Current conductors 13 are arranged between the magnetized layers 12 in every second gap, as shown in FIG. 6. Current I conducted via the current conductors 13 produces the magnetic field Ø of the electromagnetic transducer 1. The current conductors 13 are arranged such that in current conductors 13 right next to each other, the current travels in opposite directions, which means that the magnetic fields Ø intensify each other. The permanent magnetization in the magnetized layer 12 provides the transducer element 2 with basic compression while vibration is provided by means of the current 1. The current conductors 13 can be implemented e.g. by printed circuit technology. The electromechanical transducer constructed of the magnetized layers 12 has a large amount of mass since the magnetic material is heavy. Consequently, the movement of the centre of mass of the element has a considerable effect.

FIG. 7*a* shows a simplified electromechanical transducer 1 whose both surfaces are air permeable; this is shown by a broken line in FIGS. 7*a*, 7*b* and 8*a* to 8*e*. Air is thus allowed to flow via the upper and lower surfaces of the electromechanical transducer, i.e. when, for example, the transducer element 2 becomes thinner, air is discharged via both the upper and lower surfaces. In such a case, the electromechanical transducer has no pressure generation capacity, i.e. it does not produce sound pressure. Such an electromechanical transducer does, however, produce movement or force, or its transformation may be used for producing electricity. Such an electromagnetic transducer 1 can be used e.g. underneath a membrane key for producing a signal caused by a press of the key; simultaneously, the transducer 1 can be used for producing energy for charging batteries, for instance. Such an electromechanical transducer has an extremely good efficiency since no work is needed for compressing air. The basic idea of the electromechanical transducer of FIG. 7*a* is similar to that of the electromechanical transducer of FIG. 4.

The upper surface of the electromechanical transducer of FIG. 7*b* is provided with an air impermeable layer 9. The solution of FIG. 7*b* thus corresponds with the electromechanical transducer of FIGS. 1, 2 and 3. Due to the air impermeable layer 9, the electromechanical transducer 1 in question also produces acoustic sound since the mass of the transducer element 2 causes the air impermeable layer 9 to move as the thickness of the transducer element 2 varies.

FIG. 8*a* shows an electromechanical transducer 1 comprising two transducer elements 2*a* and 2*b* arranged on top of each other. Both of the transducer elements 2*a* and 2*b* can be controlled separately. If the electromechanical transducer 1 is moved, the acceleration of its centre of mass $m_0$generates energy. Such an electromechanical transducer can thus be used e.g. as a battery-charging encasement for a portable device since when being moved, the electromechanical transducer generates energy.

FIG. 8*b* shows an electromechanical transducer 1 whose lower and upper surfaces are provided with air impermeable layer 9. The structure of FIG. 8*b* corresponds with the electromechanical transducer of FIG. 5.

FIG. 8*c* shows an electromechanical transducer comprising two transducer elements 2*a* and 2*b* arranged on top of each other and an air impermeable layer 9 being provided therebetween. When the air impermeable layer 9 in such an electromechanical transducer 1 moves, it produces sound, which means that the electromechanical transducer 1 thus produces sound through itself.

The basic idea of the solution shown in FIG. 8*d* otherwise corresponds with that of FIG. 7*b* except that two transducer elements 2*a* and 2*b* are arranged on top of each other. The transducer elements 2*a* and 2*b* can be controlled either separately or conjointly, in phase or in opposite phase. In FIG. 8*e*, the upper transducer element is encapsulated such that its upper and lower surfaces are provided with an air impermeable layer 9 and air is allowed to flow freely through the lower surface of the lower transducer element. In FIGS. 9*a* to 9*c*, the electromechanical transducer is provided with one or more air permeable additional masses 15. The additional mass(es) 15 enable(s) the weight, and thus the mass effect, of the electromechanical transducer 1 to be increased. The additional mass 15 may be e.g. a perforated metal plate or a porous sintered metal plate.

FIG. 10 shows a description of an electromechanical transducer 1 according to FIG. 9*c* in greater detail. Transducer elements 2*a* and 2*b* are provided with plastic films 5 arranged on top of each other, and supporting points 6 therebetween. In the upper transducer element 2*a*, the upper surface of the plastic films 5 is provided with a metal layer 4 and, correspondingly, in the lower transducer element 2*b*, the lower surfaces of the plastic films are provided with metal layers 4. The plastic films 5 nearest to the air permeable additional mass 15 are provided with holes 8.

A signal $S_1$ is fed into the upper transducer element 2*a* via an amplifier 16*a* and, correspondingly, a signal $S_2$ is fed into the lower transducer element 2*b* via an amplifier 16*b*. The plastic films 5 nearest to the air impermeable layer 9 comprise no holes 8. The plastic film 5 located nearest to the air impermeable layer 9 and provided with a negative charge is arranged to serve as a sensor in FIG. 10. The pressure P measured by this layer, describing the pressure on the surface of the transducer 1, is fed to the amplifier as feedback. The sensor thus measures the pressure of the enclosed gap nearest to the surface of the transducer 1. This feedback linearizes e.g. the operation of the transducer 1 serving as an actuator. Linearization in real time is thus achieved by an analog system, i.e. no complex processors or the like are needed for linearization. The feedback can also be implemented by a so-called current feedback. This is established by measuring the current taken by a transducer element from the poles of a resistor or a capacitor connected in series with the transducer element, and using the measured current signal as a feedback signal.

In a noise reduction application, the aim may be to keep a desired surface of the transducer 1 immobile and/or the pressure of a desired gap unchanged. In FIG. 10, for example, the aim may be to keep the lower surface of the transducer 1 immobile and/or the pressure in the gap thereagainst unchanged. The signal $S_2$ is then set to zero, and feedback is used for trying to keep the lower surface of the transducer 1 immobile and/or the pressure on the lower surface of the transducer unchanged. The upper surface of the transducer 1 may simultaneously produce sound according to the desired signal $S_1$.

Figures 11A, 11B, 11C:
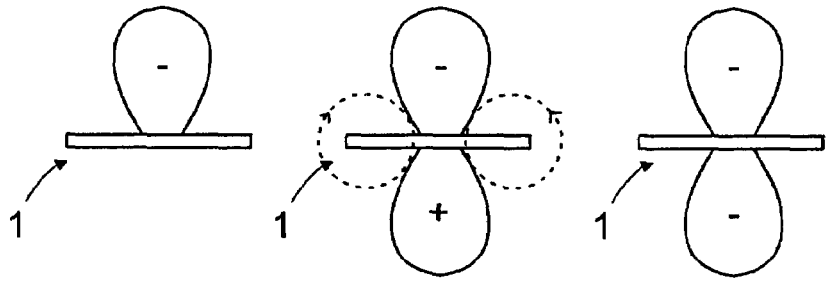

FIGS. 11*a* to 11*c* illustrate how the electromechanical transducer 1 disclosed in FIGS. 9*c* and 10 can serve as different elements. The electromechanical transducer 1 may serve e.g. as a cardioid sound source, according to FIG. 11*a*. In such a case, the variations in sound pressure thus only take place at one side of the transducer 1. Arrows B in FIG. 9*c* illustrate how e.g. the upper air impermeable layer 9 moves downwards and the different layers of the transducer element 2*a* simultaneously also move downwards. The layers of the transducer element 2*b* also move downwards but the lower surface of the transducer 1, i.e. the lower air impermeable layer 9, does not substantially move. The lower part of the transducer 1, i.e. the lower transducer element 2*b*, is thus used for producing a signal which compensates for the downwards-active movement produced by the upper part of the transducer 1, i.e. the upper transducer element 2*a*. This can thus be achieved in the above-described manner by utilizing feedback. It is also possible to feed a signal $S_1$ into the upper transducer element 2*a* and a signal whose amplitude is e.g. half the signal $S_1$ and whose phase is the opposite to that of the signal $S_1$ into the lower transducer element 2*b*. This enables the section of the upper transducer element 2*a* emitting towards the lower transducer element 2*b* to be attenuated. The magnitude of the signal to be fed into the lower transducer element 2*b* can further be reduced in accordance with the amount of attenuation of the signal of the upper transducer element 2*a* while it travels through the transducer 1. A feedback arrangement can also be utilized in this embodiment as well.

FIG. 11*b* illustrates how the transducer 1 operates as a dipole sound source. The upper air impermeable layer 9 and the layers of the upper transducer element 2*a* thus move in the same direction as the lower air impermeable layer 9 and the layers of the lower transducer element 2*b*, as illustrated by arrows C in FIG. 9*c*. The pressure effects are thus of opposite signs at opposite sides of the transducer 1.

FIG. 11*c* illustrates how the transducer 1 operates as a monopole sound source. The sound pressures at opposite sides of the transducer 1 are thus of the same sign. When the upper air impermeable layer 9 and the layers of the upper transducer element 2*a* then move downwards, the lower air impermeable layer 9 and the layers of the lower transducer element 2*b* move upwards, as illustrated by arrows D in FIG. 9*c*.

Figure 12:
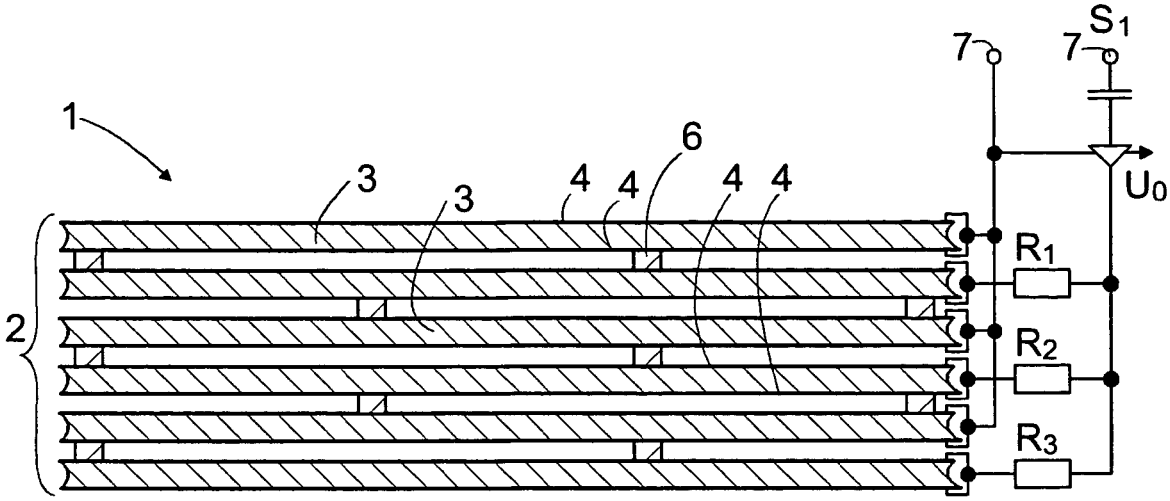

FIG. 12 shows a transducer 1 whose transducer elements 2 comprises porous layers 3. The porous layers 3 are made e.g. of a nonwoven polyester fibre material. Both surfaces of the porous layer 3 are provided with metal layers 4 e.g. by vacuum evaporation. The metal layers 4 located on both sides of the porous layer are interconnected, the porous layer 3 and the both surfaces thereof thus constituting one unit, to which an electrode is to be coupled. Since the transducer element 2 comprises no electret layers, it is necessary for the solution to employ a bias voltage, referred to as $U_0$ in FIG. 12.

A signal $S_1$ is fed into the different layers such that it is filtered using resistors $R_1$, $R_2$ or $R_3$. Naturally, there may be more porous layers equipped with metal layers 4, which means that there are also more resistors. The resistors $R_1$ to $R_3$ have different magnitudes, which means that each resistor filters off a different frequency from the signal $S_1$. When the resistor $R_1$ is selected to be the smallest one and the resistor $R_3$ the largest one, substantially all frequencies can be fed into the upper layer while a signal mainly containing low frequencies is fed into the lowest layer. When a layer vibrates at a high frequency, no large movement is needed. At low frequencies, on the other hand, the movement of a layer is quite large. At the lower layers, the total movement thereof corresponds to the magnitude of the variation in thickness of the transducer element 2. The lower layers vibrating at lower frequencies are thus capable of moving quite extensively. The first resistor $R_1$ may be e.g. in the order of 100 ohms and the second resistor $R_2$ may be e.g. five times larger than the first resistor $R_1$ and, correspondingly, the third resistor $R_3$ five times larger than the second resistor $R_2$, etc. The number of layers affects the maximum output a transducer element is capable of producing. Filtering a signal to be fed into the different layers in a different manner improves the efficiency of the transducer element 2 as a whole.

Successive porous layers 3 constitute a capacitor. In filtering, in addition to or instead of the resistors $R_1$ to $R_3$, coils may also be used whose inductance is adapted to proportionately suit the capacitance between different layers. When vibrating, the different layers also generate electric current. This also causes losses in the resistors and attenuation to the structure.

Figure 13:
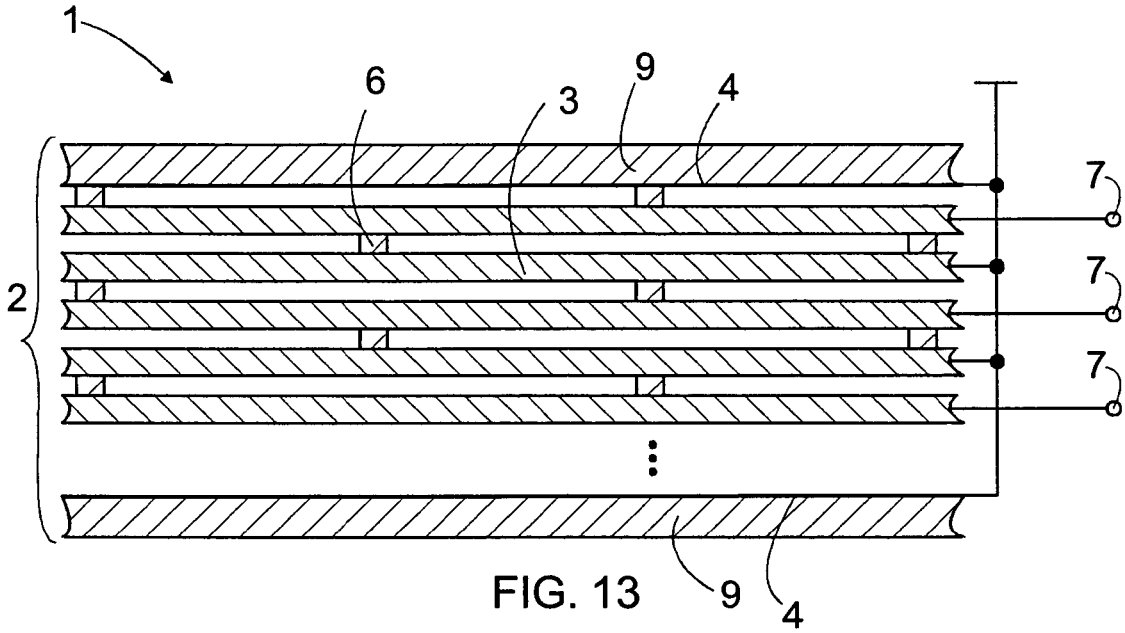

In FIG. 13, the porous layers 3 are made of an electrically conductive fibre material, such as a nonwoven carbon fibre or a nonwoven metal fibre. Electrodes 7 can then be coupled directly to a porous layer 3. The surface of the porous layer 3, on top of the fibres, may be provided e.g. with a thin spray varnish as a fibre coating agent. The thickness of the spray varnish may be in the order of 1 micrometer, in which case the varnish does not prevent air from passing through the porous layer. The varnish does, however, serve as an insulator, an air gap 10 and the varnish together preventing a short circuit between the porous layers 3.

If a more complex filtering solution than that shown in FIG. 12 is used, each electrode 7 can be provided with exactly the desired frequency. Most preferably, however, a signal comprising all frequencies is fed into the upper layer, a signal wherefrom the highest frequencies have been filtered off is fed into the middle layer, and a signal comprising substantially the lowest frequencies is fed into the lowest layer. From the highest layer, energy is emitted both upwards and downwards but since the lower layers are made of a porous material, they absorb a signal directed thereto from the upper layer. The solution of FIG. 13 can be e.g. attached to a wall by its lower surface and still no reflections substantially occur from the backward surface. If a signal is to be fed outwards both from the upper surface and the lower surface, a signal also comprising high frequencies can be fed into the layers nearest to the outer surfaces while the lowest frequencies are fed into the middle layer.

Figure 14:
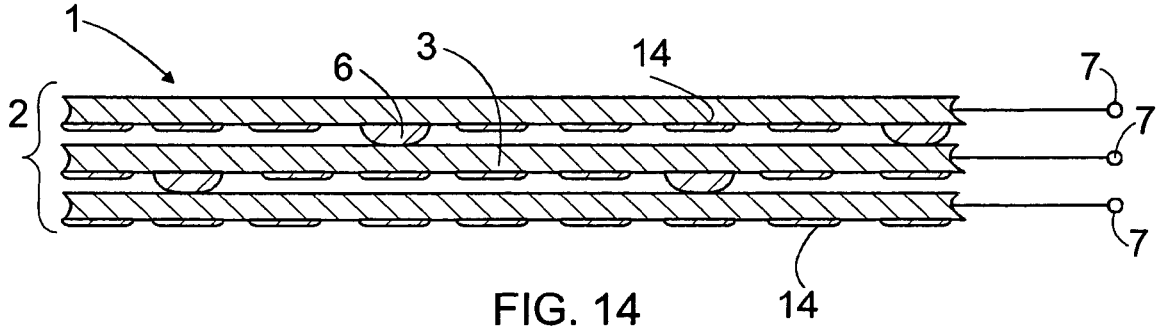

FIG. 14 shows a transducer element 2 comprising porous layers 3 that are either electrically conductive in their entirety or that are provided with electrically conductive surfaces. The surface of a porous layer 3 is provided with an electret layer 14 such that the electret material, such as a cyclic olefin copolymer COC, has been dropped or spread as a powder onto the surface of the porous layer 3. After dropping follows calendering wherein droplets or particles are flattened against the surface of the porous layer 3 by means of a roll. The size of the electret droplets may be in the range of from 0.5 to 1 mm and the distance therebetween must enable air to pass in the direction of thickness of the transducer element 2. Supporting points 6 are made of a non-conductive material. Most preferably, the supporting points 6 are made of a material corresponding to that of the electret layer 14 such that the calender roll flattening the droplets is provided with indentations that leave some droplets or powder higher in order to provide the supporting points 6. The electret layer 14 may thus be constructed either of droplets or powder such that the electret material is randomly dispersed onto the surface of the porous layer 3. The electret material may also be given the form of a desired raster pattern, for example. Furthermore, the electret material can also be given e.g. the form of stripes arranged onto the surface of the porous layer 3 by utilizing a slit nozzle in the coating procedure. When the electret layer 14 comprises separate points or zones or stripes of the electret material, no holes need to be separately provided in the electret material layer.

The drawings and the related description are only intended to illustrate the idea of the invention. In its details, the invention may vary within the scope of the claims. A transducer element may thus comprise quite a large number of layers. When the movement of the layers in the direction of thickness is connected in series, the motional amplitude of the transducer element is intensified when the number of layers increases. Furthermore, the electromechanical transducer can be provided with a desired number of transducer elements arranged on top of each other. Furthermore, the electromechanical transducers may be either straight, as shown in the figures, or curved in a desired manner. The electromechanical transducer may be constructed e.g. by forming two films such that a pair of films comprises a non-conductive layer and an electrically conductive layer. The layer structure can be provided by winding the pair of films e.g. into a form of a cylinder. The transducer element is thus provided with a capacitance between the layers and the winding produces a coil, the transducer thus being provided with a certain inductance. The films can be wrapped around an iron plate to provide an iron-core coil. The iron plate also provides a supporting structure for the transducer, and it also serves as an additional mass. The variation in the air permeability of the layers of the transducer element enables the sound emitting properties of the transducer, i.e. the directional pattern of the transducer, to be affected locally. Under similar control, the magnitude of the movement of a layer varies according to air permeability. Air permeability can be changed e.g. by changing the size of the holes 8 and/or the distances therebetween.

The invention claimed is:

1. An electromechanical transducer comprising:

at least two separately-controllable transducer elements;

at least two magnetized layers in each of the transducer elements that enable the transducer element to change its thickness;

air gaps between the layers that allow air to flow inside the transducer element in the direction of thickness of the transducer;

current conductors arranged between the magnetized layers; and controlling means for controlling the transducer elements such that the center of mass of the transducer is moved and/or a signal is generated from the movement of the center of mass.

2. A method for producing or attenuating sound pressure or vibration, the method comprising:

providing a transducer that has at least two transducer elements that change their thickness;

feeding separate control signals to each of the transducer elements; and separately controlling the amplitude and phase of each control signal fed to the transducer elements to produce a desired radiation pattern of sound pressure or vibration, whereby the center of mass of the transducer moves with acceleration corresponding to the control signals and thereby produces a counterforce used in producing the desired radiation pattern.

3. A method as claimed in claim 2, wherein different transducer elements are controlled by the same control signal but at two different transducer elements, the effect of the control signal is of opposite phase.

4. A method as claimed in claim 2, wherein the electromechanical transducer comprises at least one air impermeable layer, the electromechanical transducer being used for producing air pressure or vibration.

5. A method as claimed in claim 2, wherein the operation of the transducer is linearized by means of feedback.

6. A method as claimed in claim 5, wherein the pressure on a surface of the transducer is measured for the feedback.

7. A method as claimed in claim 2, wherein a signal is fed into different layers of the transducer element such that certain frequencies have been filtered off from the signals fed into the different layers.

* * * * *

UNITED STATES PATENT AND TRADEMARK OFFICE

CERTIFICATE OF CORRECTION

PATENT NO. : 7,376,239 B2
APPLICATION NO. : 10/682043
DATED : May 20, 2008
INVENTOR(S) : Kari Kirjavainen It is certified that error appears in the above-identified patent and that said Letters Patent is hereby corrected as shown below:

On the Title Page
Item (74) "Gerstein Borun" should be -- Gerstein & Borun --.

Signed and Sealed this

Thirtieth Day of September, 2008

JON W. DUDAS
*Director of the United States Patent and Trademark Office*